United States Patent [19]

Nagahama

[11] 4,012,981

[45] Mar. 22, 1977

[54] ELECTRONIC MUSICAL INSTRUMENT PROVIDED WITH A WAVEFORM CONVERTER FOR CHANGING A SAWTOOTH WAVE TONE SIGNAL INTO A RECTANGULAR WAVE TONE SIGNAL

[75] Inventor: Yasuo Nagahama, Hamamatsu, Japan

[73] Assignee: Nippon Gakki Seizo Kabushiki Kaisha, Japan

[22] Filed: Oct. 7, 1975

[21] Appl. No.: 620,308

[30] Foreign Application Priority Data

Oct. 9, 1974 Japan ..... 49-115630

[52] U.S. Cl. ..... 84/1.01; 84/1.25; 307/261; 307/265; 328/13; 328/150; 328/158; 328/260

[51] Int. Cl.[2] ..... G10H 1/00; G10H 5/00

[58] Field of Search ..... 84/1.01, 1.11–1.13, 84/1.19–1.26, DIG. 8, DIG. 9, DIG. 20; 307/260, 261, 265–267; 328/13, 34, 59, 150, 158, 178, 260

[56] References Cited

UNITED STATES PATENTS

| | | | |
|---|---|---|---|
| 3,715,445 | 2/1973 | Kniepkamp | 84/1.13 |
| 3,767,833 | 10/1973 | Noble et al. | 84/1.01 |
| 3,828,110 | 8/1974 | Colin | 84/1.01 |
| 3,886,834 | 6/1975 | Okamoto | 84/1.19 X |
| 3,886,836 | 6/1975 | Hiyoshi | 84/1.26 |
| 3,897,709 | 8/1975 | Hiyoshi et al. | 84/1.19 |
| 3,902,392 | 9/1975 | Nagahama | 84/1.01 |
| 3,902,396 | 9/1975 | Hiyoshi | 84/1.19 |
| 3,922,943 | 12/1975 | Niinomi | 84/1.19 X |

OTHER PUBLICATIONS

Millman & Taube, "Pulse, Digital, and Switching Waveforms" Copyright 1965 by McGraw-Hill, Inc. Library of Congress Catalog Card No. 64–66293. pp. 389–402.

*Primary Examiner*—Stanley J. Witkowski
*Attorney, Agent, or Firm*—Flynn & Frishauf

[57] ABSTRACT

A waveform converter for use with an electronic musical instrument comprises an input for receiving a sawtooth wave tone signal, an output for delivering a rectangular wave tone signal, a semiconductor active element adapted to switch the output voltage from a first to a second voltage level when the input voltage exceeds the threshold voltage level of the waveform converter, and a variable bias source coupled to the input for controlling the duty factor of the rectangular wave output tone signal. The variable bias source includes a variable D.C. voltage source and a subaudio sine wave source.

14 Claims, 2 Drawing Figures

ELECTRONIC MUSICAL INSTRUMENT PROVIDED WITH A WAVEFORM CONVERTER FOR CHANGING A SAWTOOTH WAVE TONE SIGNAL INTO A RECTANGULAR WAVE TONE SIGNAL

BACKGROUND OF THE INVENTION

This invention relates to an electronic musical instrument and more particularly to an electronic musical instrument provided with a waveform or tone color converter.

With an electronic musical instrument, sawtooth wave tone signals are selectively derived from tone generators in response to key operation on a keyboard. The sawtooth wave tone signals selectively derived out are conducted to tone coloring filters having predetermined frequency characteristics to be formed into desired musical tone signals.

Sawtooth wave tone signals are sometimes converted into rectangular wave tone signals. The reason is that the rectangular wave tone signal provides different overtones and consequently a different tone color from that obtained from the sawtooth wave tone signal. In this case, variation of the duty factor of the rectangular wave tone signal can also easily change a tone color.

A synthesizer type electronic musical instrument which is presently commercially available comprises a voltage-controlled oscillator for producing a sawtooth wave tone signal in response to a pitch-determining voltage signal from a keyboard section. The sawtooth wave tone signal thus obtained is fed to a voltage controlled filter. If the sawtooth wave tone signal is converted into a rectangular wave tone signal, the synthesizer type electronic musical instrument can also give forth a different tone color from that realized by the sawtooth wave tone signal. In this case, too, variation of the duty factor of the rectangular wave tone signal easily provides a tone color modulation.

SUMMARY OF THE INVENTION

It is accordingly the object of this invention to provide a waveform converter adapted for use with an electronic musical instrument which can easily convert a sawtooth wave tone signal into a rectangular wave tone signal and also change the duty factor of the rectangular wave tone signal.

A waveform or tone color converter embodying this invention includes circuit means comprising input and output, and a semiconductor active element such as a bipolar or unipolar transistor coupled to the input and output. The input is coupled to a sawtooth wave source. The semiconductor active element is so adapted that when an input voltage exceeds the threshold voltage of the waveform converter circuit means, an output voltage is switched from a first to a second voltage level at once, and when the input voltage falls below the threshold voltage of the waveform converter circuit means, the output voltage is switched from the second to the first voltage level at once. The above-mentioned circuit means further includes a variable D.C. voltage source coupled to the input of the circuit means and consequently produces a rectangular wave tone signal having a duty factor corresponding to the magnitude of a voltage level of the D.C. voltage source. Where a source of frequency-variable subaudio signals is coupled to the input of the waveform converter circuit, then the duty factor of a rectangular wave tone signal is subjected to a periodical variation to provide a tone color modulation.

DESCRIPTION OF THE PREFERRED EMBODIMENT

There will now be described this invention in relation to such a synthesizer type electronic musical instrument as disclosed in U.S. Pat. No. 3,886,836 issued to Teruo HIYOSHI on June 3, 1975 and assigned to the same assignee of this patent application.

Figure 1:
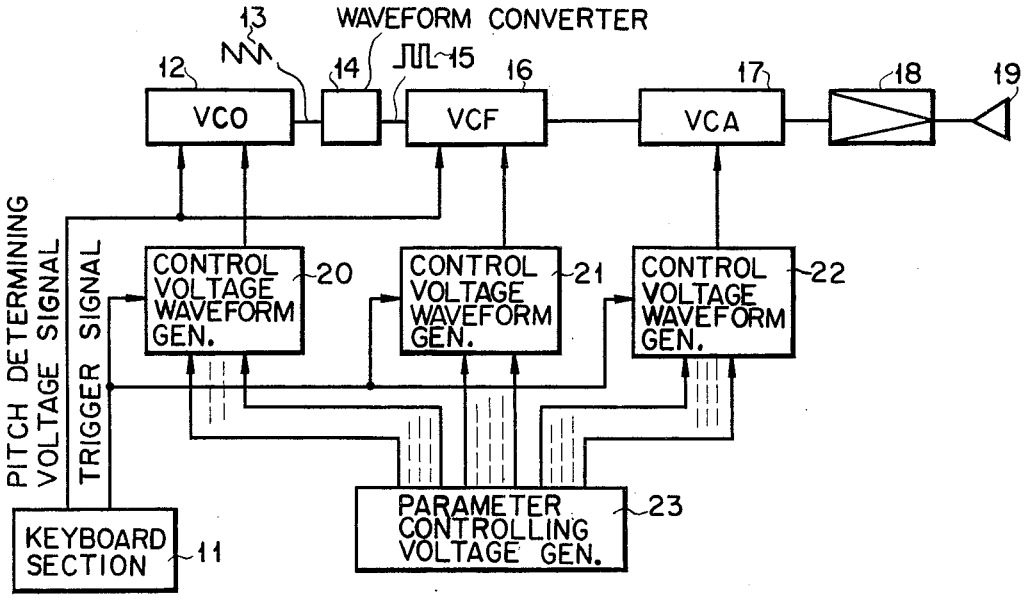
FIG. 1 is a block diagram of an electronic musical instrument containing a waveform converter embodying this invention.

Referring to FIG. 1, referential numeral 11 denotes a known keyboard section for generating a pitch-determining voltage signal having a magnitude representing the note of a key actuated on a keyboard and a trigger signal indicating the key actuation. The pitch-determining voltage signal delivered from the keyboard section 11 is coupled to a voltage-controlled oscillator 12 (hereinafter abbreviated as VCO) to produce a sawtooth wave tone signal 13 having a pitch frequency corresponding to the voltage level of a pitch-determining voltage signal. An output sawtooth wave tone signal 13 from VCO 12 is coupled to a tone color or waveform converter 14 to be changed into a rectangular wave tone signal 15. An output tone signal from the waveform converter 14 is fed to a lowpass or bandpass voltage-controlled filter 16 (hereinafter abbreviated as VCF). The output pitch-determining voltage signal from the keyboard section 11 is also coupled to VCF 16 so as to cause VCF 16 to have a cutoff frequency or frequencies corresponding to the voltage level of the pitch-determining voltage signal. An output musical tone signal from VCF 16 is coupled to a voltage-controlled amplifier 17 (hereinafter abbreviated as VCA). An output signal from VCA 17 is sent to an amplifier 18 followed by a loudspeaker 19.

Control voltage waveform generators 20, 21, 22 deliver control voltage waveforms to VCO 12, VCF 16 and VCA 17. An output sawtooth wave tone signal from VCO 12 has its oscillation frequency modified according to the shape of a control voltage waveform from the control voltage waveform generator 20. VCF 16 is adapted to vary its cutoff frequency or frequencies according to the shape of a control voltage waveform from the control voltage waveform generator 21. VCA 17 is adapted to vary its gain according to the shape of a control voltage waveform from the control voltage waveform generator 22 to thereby provide a desired envelope to the output signal from VCF 16.

The control voltage waveform generators 20 to 22 commence the production of a control voltage waveform in response to the trigger signal delivered from the keyboard section 11.

The control voltage waveform may have controllable parameters such as an initial level, attack time, attack level, first decay time, sustain level and second decay time to define the shape of the control voltage waveform. To this end, the control voltage waveform generators 20, 21, 22 are constructed into a voltage control type to control the above-mentioned parameters in response to parameter-controlling voltage signals supplied from a parameter-controlling voltage signal generator 23.

With the above-mentioned type of electronic musical instrument, the waveform converter 14 is connected between VCO 12 and VCF 16, but, if required, may be disconnected from the circuit between VCO 12 and VCF 16 by means of a switch to directly couple the output of VCO 12 to the input of VCF 16.

Figure 2:
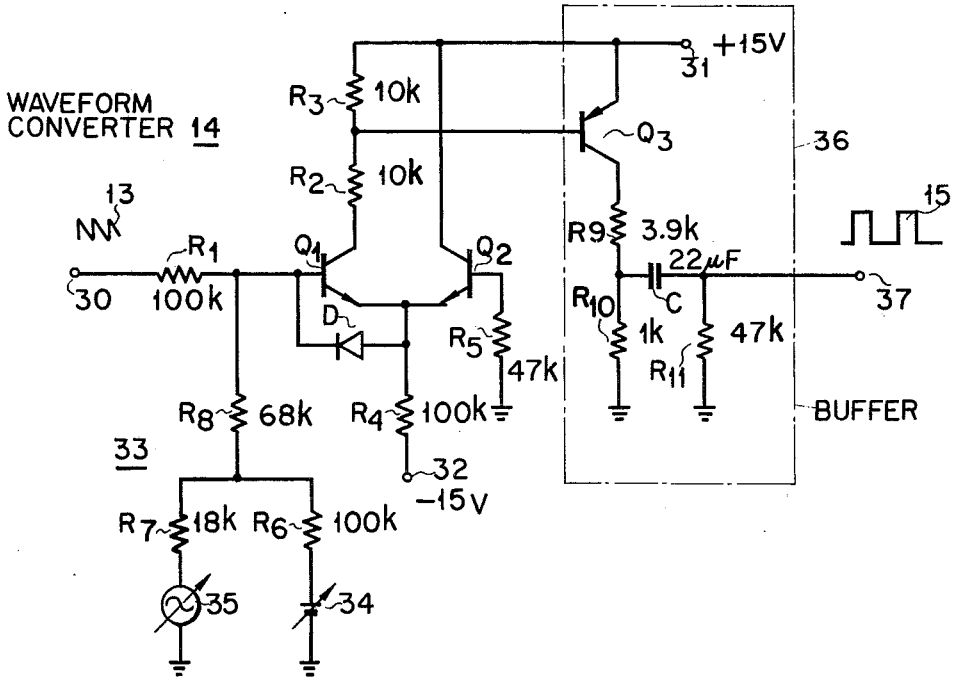
FIG. 2 illustrates an example of the circuit diagram of FIG. 1.

There will now be described by reference to FIG. 2 an embodiment of the waveform converter according to this invention which may be used with the electronic musical instrument arranged as shown in FIG. 1.

An input terminal 30 of the waveform converter 14 receives a sawtooth wave tone signal 13 from VCO 12 and is connected to the base of an NPN type bipolar transistor $Q_1$ through a resistor $R_1$. The collector of transistor $Q_1$ is connected to a positive power supply terminal 31 through first and second collector resistors $R_2$ and $R_3$. The emitter of transistor $Q_1$ is connected to a negative power supply terminal 32 through an emitter resistor $R_4$. There is provided for temperature compensation a second NPN type transistor $Q_2$, the collector of which is directly connected to the positive power supply terminal 31, the emitter of which is connected to the emitter of transistor $Q_1$, and the base of which is connected to ground through a resistor $R_5$. A transistor-protecting diode D is connected between the base and emitter of transistor $Q_1$ with the indicated polarity.

Connected to the base of transistor $Q_1$ is a variable bias circuit 33 for changing the duty factor of a rectangular wave output signal. This variable bias circuit 33 is provided with a variable D.C. voltage source 34 whose voltage can be changed, for example, from 0 to 10 volts. The positive terminal of the variable D.C. voltage source 34 is connected to the base of transistor $Q_1$ through resistors $R_6$ and $R_8$. The above-mentioned variable bias circuit 33 may include a variable frequency signal source 35 for generating a subaudio sine wave whose frequency can be varied, for example, from 0.5 to 15 Hz. The variable frequency signal source 35 is connected to the junction of the resistors $R_6$ and $R_8$ through a resistor $R_7$. An output subaudio signal from the variable frequency signal source 35 may have an amplitude of, for example, $\pm 1.5\ V_{p\text{-}p}$. The aforesaid sawtooth wave signal 13 has an amplitude of, for example, $\pm 2\ V_{p\text{-}p}$.

A rectangular wave output signal from the transistor $Q_1$ is conducted from the junction of the first and second collector resistors $R_2$ and $R_3$ to the base of a PNP type transistor $Q_3$ included in a buffer circuit or impedance-converting circuit 36. The emitter of transistor $Q_3$ is directly connected to the positive power supply terminal 31 and the collector thereof is grounded through resistors $R_9$ and $R_{10}$. The junction of the resistors $R_9$ and $R_{10}$ is connected through a capacitor C to the output terminal 37 of the waveform converter 14 which is grounded through a resistor $R_{11}$. Drawn out from the output terminal 37 is a rectangular wave tone signal 15 having an amplitude of 3 volts.

With the waveform converter 14 arranged as described above, the collector and emitter resistors $R_2$, $R_3$, $R_4$ of the transistor $Q_1$ have a relatively large total resistance value of, for example, 120 kiloohms. Where, therefore, a base input voltage defined by the sawtooth wave signal 13 and output signals from the bias sources 34 and 35 exceeds the threshold voltage of the transistor $Q_1$ which is equal to the emitter voltage plus the base-to-emitter voltage of transistor $Q_1$, then the transistor $Q_1$ is driven from cutoff to saturation. Conversely where the aforesaid base input voltage falls below the threshold voltage of the transistor $Q_1$, the transistor $Q_1$ is driven from saturation to cutoff. Obviously, therefore, an output signal from the collector of the transistor $Q_1$ presents a rectangular waveform. In this case, the duty factor of the rectangular wave output signal from the transistor $Q_1$ can be varied according to the voltage value of the variable D.C. voltage source 34. Further, the duty factor can be periodically varied by the subaudio signal source 35.

The base-to-emitter voltage of a transistor varies with temperature. Therefore, the threshold voltage of the transistor $Q_1$ varies its base-to-emitter voltage. To prevent the threshold voltage level of the transistor $Q_1$ from varying with temperature, there is provided another transistor $Q_2$, which is desired to have the same temperature characteristics as the transistor $Q_1$. Where the base-to-emitter voltage of transistor $Q_1$ rises due to temperature change, that of the transistor $Q_2$ also increases, thereby decreasing the voltage level at the emitters of both transistors $Q_1$, $Q_2$. Thus the increased base-to-emitter voltage of the transistor $Q_1$ and its decreased emitter voltage offset each other, enabling the threshold voltage of the transistor $Q_1$ to be kept constant. Further where the base-to-emitter voltage of transistor $Q_1$ falls, then its emitter voltage is conversely elevated, thereby maintaining its threshold voltage at a fixed level. The diode D is provided to protect the transistor $Q_1$, should its base be driven prominently negative. The circuit of FIG. 2 uses bipolar transistors as semiconductor active elements. However, unipolar transistors may be used instead.

What is claimed is:

1. An electronic musical instrument comprising sawtooth wave tone signal generating means, wave-form-converting means for receiving a sawtooth wave tone signal from said sawtooth wave tone signal generating means and converting the sawtooth wave tone signal into a rectangular wave tone signal, tone coloring filter means coupled to said waveform converting means, and musical sound-reproducing means coupled to said tone coloring filter means, said waveform converting means comprising:

circuit means including an input coupled to said sawtooth wave tone signal generating means, an output coupled to said tone coloring filter means, a first bipolar transistor having base, collector and emitter electrodes, said base and collector electrodes being respectively coupled to said input and output for switching an output voltage level at said output from a first to a second voltage level when an input voltage at said input exceeds a given threshold voltage, first and second power supply terminals, and collector and emitter resistors for coupling said collector and emitter electrodes of said first bipolar transistor to said first and second power supply terminals respectively, said emitter and collector resistors having so large a total resistance value that when the input voltage at said input of said circuit means exceeds said threshold voltage, said first bipolar transistor is driven into saturation from cutoff; and variable bias means coupled to said input of said circuit means to apply a bias voltage on said input of said circuit means for varying the duty factor of the rectangular wave tone signal.

2. The electronic musical instrument according to claim 1, wherein said bias means includes a variable D.C. voltage source.

3. The electronic musical instrument according to claim 1, wherein said bias means includes a variable frequency sine wave source.

4. The electronic musical instrument according to claim 2, wherein said bias means includes a variable frequency sine wave source.

5. The electronic musical instrument according to claim 1 further including a diode coupled between the base and emitter electrodes of said first bipolar transistor.

6. The electronic musical instrument according to claim 1, wherein said circuit means further includes a second bipolar transistor coupled to said first bioplar transistor to counterbalance variations in the threshold voltage of said circuit means which may be caused by temperature change.

7. The electronic musical instrument according to claim 1, wherein said circuit means includes a second bipolar transistor of the same conductivity type as said first bipolar transistor and having base, collector and emitter electrodes, the collector and emitter electrodes of said second bipolar transistor being coupled to said first power supply terminal and the emitter of said first bipolar transistor respectively; and a resistor means for coupling said base electrode of said bipolar second transistor to ground.

8. An electronic musical instrument comprising:

a keyboard section for generating a pitch-determining voltage signal having a magnitude representing the note of an operated key on a keyboard;

a voltage controlled oscillator means coupled to receive the pitch-determining voltage signal from said keyboard section for producing a sawtooth wave tone signal having a pitch frequency corresponding to the magnitude of the pitch-determining voltage signal;

a waveform converter means for converting the sawtooth wave tone signal into a rectangular wave tone signal, said waveform converter means including circuit means having:

an input coupled to receive said sawtooth wave tone signal from said voltage controlled oscillator means;

an output;

a first bipolar transistor having base, collector and emitter electrodes, said base and collector electrodes being respectively coupled to said input and output for switching an output voltage level at said output from a first to a second voltage level when an input voltage at said input exceeds a given threshold voltage;

first and second power supply terminals; and collector and emitter resistors for coupling said collector and emitter electrodes of said bipolar transistor to said first and second power supply terminals respectively, said emitter and collector resistors having so large a total resistance value that when the input voltage at said input of said circuit means exceeds said threshold voltage, said first bipolar transistor is driven into saturation from cutoff;

means coupled to said circuit means of said waveform converter means for controlling the duty factor of the rectangular wave tone signal; and sound-reproducing means coupled to said output of said circuit means of said waveform converter generating means.

9. The electronic musical instrument according to claim 8, wherein said circuit means includes a second bipolar transistor of the same conductivity type as said first bipolar transistor and having base, collector and emitter electrodes, the collector and emitter electrodes of said second bipolar transistor being coupled to said first power supply terminal and the emitter of said first bipolar transistor respectively; and a resistor means for coupling said base electrode of said second bipolar transistor to ground.

10. The electronic musical instrument according to claim 8 further including a diode coupled between the base and emitter electrodes of said first bipolar transister.

11. The electronic musical instrument according to claim 8, wherein said means for controlling the duty factor of the rectangular wave tone signal comprises a variable bias means coupled to said input of said circuit means, said variable bias means including a variable DC voltage source.

12. The electronic musical instrument according to claim 11, wherein said bias means further includes a variable frequency sine wave source.

13. The electronic musical instrument according to claim 8, wherein said means for controlling the duty factor of the rectangular wave tone signal comprises variable bias means coupled to said input of said circuit means, said variable bias means including a variable frequency sine wave source.

14. The electronic musical instrument according to claim 8, wherein said circuit means further includes a second bipolar transistor coupled to said first bipolar transistor to counterbalance variations in the threshold voltage of said circuit means which may be caused by temperature change.

* * * * *